US006450716B1

(12) United States Patent
Szekely

(10) Patent No.: US 6,450,716 B1
(45) Date of Patent: Sep. 17, 2002

(54) ROUND ROTARY DISPENSER WITH PRESSURE RELIEF

(75) Inventor: Alex Szekely, Jackson, NJ (US)

(73) Assignee: The Plastek Group, Erie, PA (US)

( * ) Notice: Subject to any disclaimer, the term of this patent is extended or adjusted under 35 U.S.C. 154(b) by 0 days.

(21) Appl. No.: 09/928,589

(22) Filed: Aug. 13, 2001

(51) Int. Cl.[7] ..... A45D 40/04

(52) U.S. Cl. ..... 401/79; 401/266; 401/175; 401/171

(58) Field of Search ..... 401/79, 75, 68, 401/266, 175, 171; 222/491, 492, 495, 496

(56) References Cited

U.S. PATENT DOCUMENTS

| | | | | |
|---|---|---|---|---|
| 3,756,730 A | | 9/1973 | Spatz | |
| 4,865,231 A | | 9/1989 | Wiercinski | |
| 5,000,356 A | | 3/1991 | Johnson et al. | |
| 5,697,531 A | | 12/1997 | Fattori | |
| 5,725,133 A | | 3/1998 | Iaia | |
| 5,839,622 A | | 11/1998 | Bicknell et al. | |
| 5,879,096 A | | 3/1999 | Franta et al. | |
| 6,039,483 A | | 3/2000 | Szekely | |
| 6,086,276 A | * | 7/2000 | Gueret | 401/75 |
| 6,116,803 A | | 9/2000 | Szekely et al. | |
| 6,210,061 B1 | * | 4/2001 | Johnson | 401/175 |

FOREIGN PATENT DOCUMENTS

| | | |
|---|---|---|
| EP | 0 312 165 | 4/1989 |

* cited by examiner

*Primary Examiner*—David J. Walczak
(74) *Attorney, Agent, or Firm*—Bachman & LaPointe, P.C.

(57) ABSTRACT

A rotary dispenser with internal pressure relief includes a housing; an elevator slidably and non-rotatably disposed in the housing; a dome slidably and rotatably mounted relative to the housing and having at least one aperture for dispensing product from within the housing; a drive member fixed relative to the dome and rotatably engaged with the elevator whereby rotation of the drive member relative to the elevator slides the elevator relative to the housing; and a pressure relief member including a cam and a cam follower, one of the cam and the cam follower being associated with the dome and the other of the cam and the cam follower being associated with the housing, the cam follower being rotatably engaged with the cam whereby rotation of the housing relative to the dome rotates one of the cam and the cam follower relative to the other of the cam and the cam follower, the cam having at least one first cam surface for causing axial movement of the dome toward the elevator and at least one second cam surface for allowing axial movement of the dome away from the elevator.

11 Claims, 1 Drawing Sheet

ROUND ROTARY DISPENSER WITH PRESSURE RELIEF

BACKGROUND OF THE INVENTION

The invention relates to a rotary dispenser for dispensing deodorants, cremes, gels and the like, and is particularly drawn to dispensers of such products wherein the products are sensitive to pressure.

In the deodorant industry, one popular form of the product is a creme or gel which is dispensed from a dispenser through rotary, pushup or other mechanisms which force material out of an applicator portion, typically an apertured applicator surface. Such compositions are quite sensitive to pressure, and small increases beyond atmospheric pressure can lead to breaking down of the composition. Further, the structure of typical dispensers allows for additional products to continue to dispense from the dispenser, or weep after use, as a result of remaining excess pressure within the housing.

A number of attempts have been made to address this issue. For example, U.S. Pat. No. 6,116,803 to Szekely, discloses a dispenser wherein the applicator surface is positioned on a "dome" which floats, or can move relative to the housing, such that after use any internal pressure biases the dome upwardly to relieve same.

Numerous other efforts have been made to provide mechanisms whereby internal increased pressure can be relieved. These mechanisms are drawn to a partial withdrawing of an elevator mechanism within the housing that is conventionally used to drive the product.

Although some of these mechanisms do provide relief of pressure, the need remains for an effective and reliable structure whereby internal pressure is relieved. This need extends to a mechanism which is simple and acceptable to the consumer, and which is not problematic during manufacture of the package and/or filling of the product.

It is therefore the primary object of the present invention to provide such a dispenser.

Other objects and advantages of the present invention will appear hereinbelow.

SUMMARY OF THE INVENTION

In accordance with the present invention, the foregoing objects and advantages have been readily attained.

In accordance with the present invention, a rotary dispenser is provided having internal pressure relief, which dispenser comprises a housing; an elevator slidably and non-rotatably disposed in said housing; a dome slidably and rotatably mounted relative to said housing and having at least one aperture for dispensing product from within said housing; a drive member fixed relative to said dome and rotatably engaged with said elevator whereby rotation of said drive member relative to said elevator slides said elevator relative to said housing; and a pressure relief member comprising a cam and a cam follower, one of said cam and said cam follower being associated with said dome and the other of said cam and said cam follower being associated with said housing, said cam follower being rotatably engaged with said cam whereby rotation of said housing relative to said dome rotates one of said cam and said cam follower relative to the other of said cam and said cam follower, said cam having at least one first cam surface for causing axial movement of said dome toward said elevator and at least one second cam surface for allowing axial movement of said dome away from said elevator.

In accordance with a further aspect of the present invention, a rotary dispenser is provided having mechanism for internal pressure relief, which dispenser comprises a housing; an elevator slidably and non-rotatably disposed in said housing; a dome slidably and rotatably mounted relative to said housing and having at least one aperture for dispensing product from within said housing; a drive member fixed relative to said dome and rotatably engaged with said elevator whereby rotation of said drive member relative to said elevator slides said elevator relative to said housing; and means associated between said dome and said housing for sequentially moving said dome toward said elevator and away from said elevator responsive to rotation of said dome relative to said housing.

The rotary dispenser of the present invention has a substantially round housing and operative dome portion which can advantageously be incorporated into outer housing structures so as to provide a final product having uniformly manufactured internal parts and different external appearance.

BRIEF DESCRIPTION OF THE DRAWINGS

A detailed description of the present invention follows, with reference to the attached drawings, wherein.

DETAILED DESCRIPTION

The invention relates to a rotary dispenser having a mechanism for providing internal pressure relief. More particularly, the invention relates to a rotary dispenser having a round housing and dome structure which provides for simple and reliable use, and also having a pressure relief mechanism which allows for rapid dispensing of a desired amount of material followed by relief of pressure inside the housing, thereby avoiding or at least reducing problems in the industry associated with pressure applied to various cosmetic gel and creme products such as deodorants and the like, which can break down into constituent components when pressurized, and which can also weep through the applicator surface after use.

Figure 1:
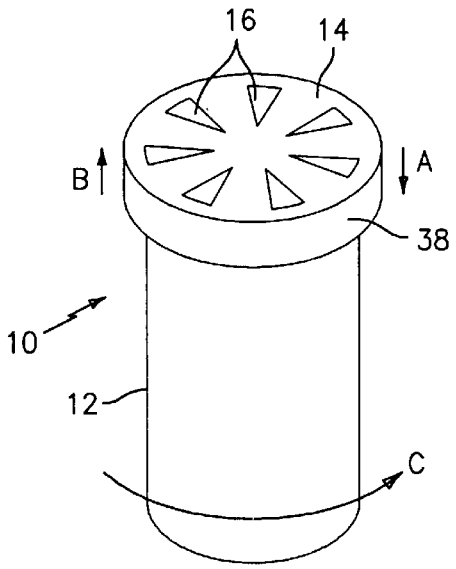
FIG. 1 is a perspective view of a rotary dispenser in accordance with the present invention.

FIG. 1 shows a typical round rotary dispenser 10 having a housing 12 and a dome 14. The dome 14 has a plurality of apertures 16 through which product is dispensed upon rotation of housing 12 relative to dome 14. Depending upon the type of material to be dispensed, aperture 16 could be provided having angled transfer surfaces such as those disclosed in U.S. Pat. No. 6,039,483 to Szekely, which help to transfer material to the applicator surface without pressure as desired.

Figure 2:
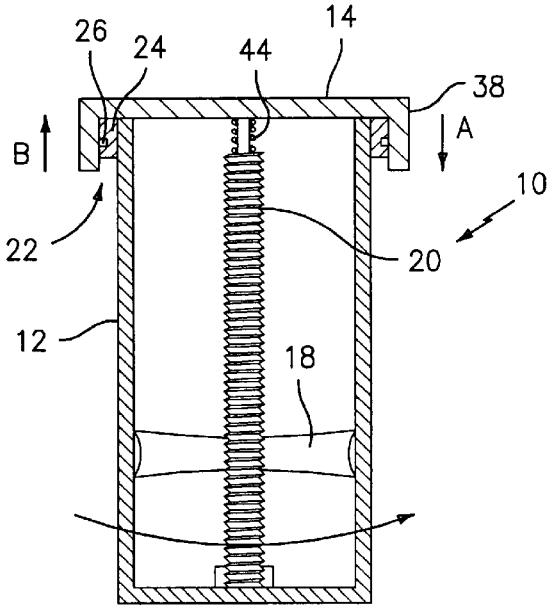
FIG. 2 is a side schematic view of a dispenser in accordance with the present invention.

Turning to FIG. 2, the internal mechanism of dispenser 10 is further illustrated. As shown, an elevator member 18 is positioned within housing 12 in sliding and substantially sealing relationship with the inner wall surface of housing 12. Also provided is a drive member 20, in this case a threaded rod, which is provided in threaded engagement with elevator 18 such that rotation of drive member 20 relative to elevator 18 causes elevator 18 to displace along drive member 20 so as to force product toward dome 14 and through apertures 16 as desired. Dome 14 is advantageously rotatably mounted relative to housing 12, and drive member 20 is advantageously non-rotatably mounted relative to dome 14 such that rotation of housing 12 relative to dome 14 results in rotation of drive member 20 relative to elevator 18 as desired, and as is well known in the art.

The non-rotatable mounting of elevator 18 within housing 12 may advantageously be accomplished by providing the outer peripheral edge of elevator 18 and/or the inner wall surface of housing 12 with flats or other structure which tend to reduce or prohibit rotation, while nevertheless allowing translation of elevator 18 along drive member 20 as desired.

Drive member 20 may advantageously be fixedly mounted relative to dome 14 using any structure appropriate for this connection. As will be further discussed below, it is a particularly advantageous feature of the present invention that dome 14 can slide downwardly (arrow A) and upwardly (arrow B) relative to elevator 18 during operation, and a sliding but non-rotatable interaction between drive member 20 and dome 14 is therefore desirable. As discussed below, a spring or other biasing member is advantageously positioned between dome 14 and drive member 20.

Figure 3:
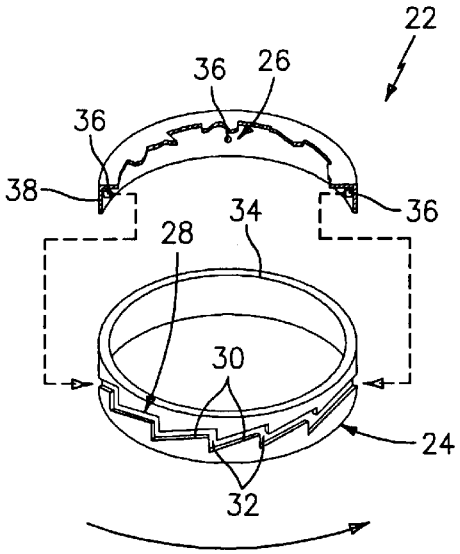
FIG. 3 is partially sectional perspective view of a pressure relief mechanism of the present invention.

In accordance with the invention, and referring also to FIG. 3, a cam and cam follower assembly 22 is advantageously provided in accordance with the present invention and associated between housing 12 and dome 14 such that rotation of housing 12 relative to dome 14 as shown in FIGS. 1–3 by arrow C results not only in advancing of elevator 18 along drive member 20, but simultaneously with a first downward motion of dome 14 relative to elevator 18 (arrow A), followed by an upward motion (arrow B) of dome 14 relative to elevator 18, as desired.

The downward motion portion advantageously assists in dispensing material through aperture 16 to the outside surface of dome 14 for application to a desired area. The subsequent upward motion of dome 14 advantageously serves to relieve pressure generated within housing 12 by the initial motion of elevator 18 and dome 14 so as to avoid undesirable breakdown of the product contained within housing 12, and further to avoid undesirable weeping of product through aperture 16 after use.

In accordance with the present invention, cam/cam follower assembly 22 advantageously includes a cam member 24 and a cam follower 26 which are associated, respectively, with dome 14 and housing 12, or vice versa. Cam member 24 is provided as a substantially round member having a slot 28 or other structure adapted to define at least one first cam surface 30 adapted for causing movement of dome 14 in the direction of arrow A, and having at least one second cam surface 32 adapted for causing or allowing motion of dome 14 relative to elevator 18 in the direction of arrow B.

FIG. 3 shows cam member 24 as a ring 34 having slot 28 defined in an outer peripheral edge thereof, with cam follower 26 being a series of inwardly-directed projections 36 which extend inwardly from a downwardly-depending sleeve 38 of dome 14. It should readily be appreciated that as housing 12 is rotated relative to dome 14, projections 36 travel in slot 28 and move downwardly when engaged by first cam surfaces 30, and then upwardly when reaching second cam surfaces 32.

In accordance with the invention, first cam surfaces are advantageously provided having a shallow slope, as shown, which slope is selected so as to provide the desired amount of downward motion of dome 14 relative to elevator 18 per rotation or rotation segment of housing 12 relative to dome 14. Further, second cam surfaces 32 are advantageously provided being substantially vertical such that release of pressure occurs when projections 36 reach second cam surfaces 32, without requiring any further rotation of housing 12 relative to dome 14.

In accordance with the illustrated embodiment of the present invention, ring 34 is fixed or otherwise secured at an upper edge of housing 12, and has slot 28 defined on an outwardly facing radial surface, while projections 36 extend inwardly from an inner surface of sleeve 38. It should readily be appreciated that cam and cam follower could be positioned in an inverse relationship, well within the scope of the invention. In such an inverse relationship, slot 28 would be defined on an inwardly facing surface of sleeve 38, and projections 36 would be positioned extending radially outwardly from the upper edge of housing 12.

Figure 4:
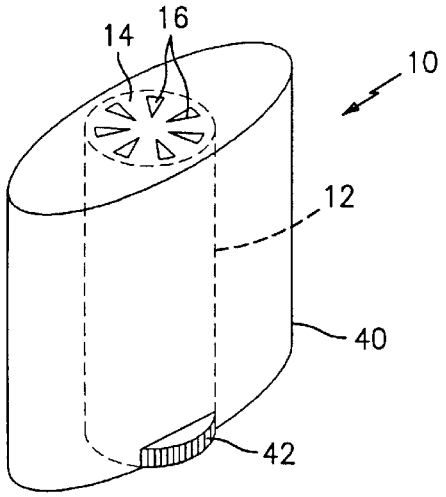
FIG. 4 shows an inner and outer housing assembly in accordance with the present invention.

Turning now to FIG. 4, it is a further aspect of the present invention that dispenser 10 having a substantially round outer surface can advantageously be positioned within a further, or outside housing 40 (see FIG. 4), and dome 14 extended so as to mate properly with outer housing 40, while housing 12 is, in this configuration, an inner housing having a portion 42 accessible from outside of outer housing 40 so that housing 12 can be rotated relative to dome 14 and outer housing 40 as desired. This advantageously allows for a substantially uniform inner structure such as dispenser 10 to be positioned within outer housings 40 having various different appearances, so that outwardly differently appearing products can be prepared using substantially the same internal components. This is particularly advantageous in accordance with the present invention.

Returning to FIG. 2, a biasing member 44 can be positioned so as to urge dome 14 upwardly and away from elevator 18. In this embodiment, biasing member 44 is a spring positioned between drive member 20 and dome 14. When projections 36 reach substantially vertical second cam surfaces 32, biasing member 44 causes upward movement of dome 14 relative to elevator 18 as desired.

In this regard, any suitable structure could be provided for slidably and non-rotatably engaging drive member 20 and dome 14, for example through a non-round post on drive member 20 and a corresponding sleeve on dome 14 for receiving the non-round post, and with biasing member 44 disposed around the post and sleeve and engaging dome 14 and drive member 20. Of course, other structures could be used.

It should readily be appreciated that the dispenser in accordance with the present invention can advantageously be used with any flowable or extrudable material, and is particularly advantageous when used with those materials that are adversely impacted by increases in pressure, for example above ambient or atmospheric pressure. Such substances are quite common in the deodorant industry, as well as many others, and dispenser 10 in accordance with the present invention advantageously allows for rapid and controlled dispensing of certain amounts of material, while also reliably providing for release of pressure as desired so as to avoid break down of the product, and/or weeping of the product through aperture 16 after use.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A rotary dispenser with internal pressure relief, comprising:

a housing;

an elevator slidably and non-rotatably disposed in said housing;

a dome slidably and rotatably mounted relative to said housing and having at least one aperture for dispensing product from within said housing;

a drive member fixed relative to said dome and rotatably engaged with said elevator whereby rotation of said drive member relative to said elevator slides said elevator relative to said housing; and a pressure relief member comprising a cam and a cam follower, one of said cam and said cam follower being associated with said dome and the other of said cam and said cam follower being associated with said housing, said cam follower being rotatably engaged with said cam whereby rotation of said housing relative to said dome rotates one of said cam and said cam follower relative to the other of said cam and said cam follower, said cam having at least one first cam surface for causing axial movement of said dome toward said elevator and at least one second cam surface for allowing axial movement of said dome away from said elevator.

2. The dispenser of claim 1, wherein said housing has a substantially round cross section.

3. The dispenser of claim 1, further comprising a biasing member for exerting a force on said dome for moving said dome away from said elevator when said cam follower is aligned with said at least one second cam surface.

4. The dispenser of claim 3, wherein said biasing member is positioned between said dome and said drive member.

5. The dispenser of claim 1, wherein said dome has a central applicator surface and a sleeve portion extending from said applicator surface and slidably and rotatably engaging said housing.

6. The dispenser of claim 1, wherein said cam comprises a first round member having a slot disposed therein, said slot defining said at least one first cam surface and said at least one second surface, and wherein said cam follower comprises a second member adapted to rotate relative to said first round member and having at least one projection engaging said slot.

7. The dispenser of claim 6, wherein one of said first round member and said second member is fixed relative to said dome and the other of said first round member and said second member is fixed relative to said housing.

8. The dispenser of claim 6, wherein said first round member comprises a ring fixed relative to one of said dome and said housing and having a surface facing the other of said dome and said housing, said slot being defined on said surface.

9. The dispenser of claim 1, further comprising an outer housing member fixed relative to said dome, said housing being rotatably mounted within said outer housing member and accessible outside of said outer housing member for rotation.

10. The dispenser of claim 1, further comprising a product contained in said housing, said product comprising a substance which is adversely affected by increases in pressure.

11. A rotary dispenser with internal pressure relief, comprising:

a housing;

an elevator slidably and non-rotatably disposed in said housing;

a dome slidably and rotatably mounted relative to said housing and having at least one aperture for dispensing product from within said housing;

a drive member fixed relative to said dome and rotatably engaged with said elevator whereby rotation of said drive member relative to said elevator slides said elevator relative to said housing; and means associated between said dome and said housing for sequentially moving said dome toward said elevator and away from said elevator responsive to rotation of said dome relative to said housing.

* * * * *